US005758232A

United States Patent [19]

Ikunami

[11] Patent Number: 5,758,232

[45] Date of Patent: May 26, 1998

[54] IMAGE FORMING APPARATUS HAVING CARTRIDGE FOR DEVELOPING DEVICES

[75] Inventor: Yoshikazu Ikunami, Hachioji, Japan

[73] Assignee: Konica Corporation, Japan

[21] Appl. No.: 730,875

[22] Filed: Oct. 18, 1996

[30] Foreign Application Priority Data

Oct. 24, 1995 [JP] Japan ..... 7-275828

[51] Int. Cl.[6] ..... G03G 21/16; G03G 21/18

[52] U.S. Cl. ..... 399/111; 399/113

[58] Field of Search ..... 399/110–114

[56] References Cited

U.S. PATENT DOCUMENTS

| | | | |
|---|---|---|---|
| 5,220,386 | 6/1993 | Aoki et al. | 399/71 |
| 5,249,026 | 9/1993 | Kojima | 399/112 |
| 5,298,946 | 3/1994 | Haneda et al. | 399/112 |
| 5,402,212 | 3/1995 | Ito et al. | 399/111 |
| 5,442,421 | 8/1995 | Kojima | 399/112 |
| 5,444,515 | 8/1995 | Haneda et al. | 399/112 |
| 5,486,898 | 1/1996 | Fujii et al. | 399/112 |
| 5,528,343 | 6/1996 | Tada et al. | 399/113 |
| 5,537,188 | 7/1996 | Haneda | 399/112 |
| 5,579,086 | 11/1996 | Ikunami et al. | 399/112 |

*Primary Examiner*—Matthew S. Smith
*Attorney, Agent, or Firm*—Jordan B. Bierman; Bierman, Muserlian and Lucas

[57] ABSTRACT

An image forming apparatus includes an image forming body, a developing device, a transfer device, a fixing device, and a processing device for image formation. The apparatus further includes a first body including the transfer device and a second body provided over the transfer device including the image forming body, and at least one of a processing device including a charger for charging the image forming body, the developing device, and a cleaning device for cleaning the image forming body. The second body is movable with respect to the first body, and movable between a first position in which an image formation can be carried out and a second position in which the second body is drawn out. The processing device can be drawn out from the second body when the second body is located at the first position.

8 Claims, 8 Drawing Sheets

IMAGE FORMING APPARATUS HAVING CARTRIDGE FOR DEVELOPING DEVICES

BACKGROUND OF THE INVENTION

The present invention relates to an image forming apparatus wherein charging, image exposure and developing means are located on the periphery of an image forming body, a toner image is formed on the circumference of an image forming body due to rotation thereof and the image is transferred onto a recording sheet.

In the field of image forming apparatus, specifically, an electrophotographic copying machine used for office work or an image forming apparatus used as a terminal device, various apparatus constituting that each of image forming means utilizing an integral image forming body, a charging device, a developing device and a cleaning device and they, as a drum carriage, can be removed from the apparatus for facilitating maintenance operations such as jamming clearance.

However, conventional apparatuses are so structured that developing means are attached or detached in such a way that the drum carriage must be withdrawn from the apparatus. Accordingly, even when the only developing means is replaced, the drum carriage must be moved every time, consuming time. In addition, under status that the drum carriage is removed, when developing means is replaced, balance of the apparatus is lost so that, in worse cases, there is a possibility that the apparatus tips over or the developing means drops on the floor.

In solving the above-mentioned issues, the object of the present invention is to provide an image forming apparatus capable of being attached or detached safely and surely with simple operation of the developing means.

The above-mentioned object is attained by either of the following four structures.

The first structure is an image forming apparatus having a developing means which forms a toner image on the image forming body, a transfer means which transfers the above-mentioned toner image onto the recording sheet and a fixing means which fixes the toner image on the recording sheet, wherein, in the first main body including the transfer means and the second main body which is located above the transfer means and which includes at least one processing means for image forming and the image forming body, the second main body can be removed from the first main body, it is movable between the first position where an image can be formed and the second position where the second main body is withdrawn and the above-mentioned processing means can be drawn from the second main body when the second main body is located at the first position.

The second structure is an image forming apparatus having at least an image forming body and a developing means which forms a toner image on the above-mentioned image forming body, wherein the above-mentioned developing means or a development cartridge housing the above-mentioned developing means is attached to or detached from the front of the apparatus.

The third structure is an image forming apparatus having at least an image forming body, a developing means which forms the toner image onto the above-mentioned image forming body, a transfer means which transfers the toner image formed on the above-mentioned image forming body onto the recording sheet and a fixing means which fixes the above-mentioned toner image on the recording sheet, wherein the second main body located above the above-mentioned transfer means and upstream side of the above-mentioned fixing means with respect to a sheet feeding direction and movable in perpendicular direction and approximately horizontal direction from the image forming surface of the above-mentioned image forming body includes the above-mentioned image forming body and the above-mentioned developing means, and the above-mentioned developing means or the above-mentioned development cartridge housing the above-mentioned developing means is detached from the front of the apparatus in the paper feeding direction, when the above-mentioned second main body is at a position where image can be formed.

The fourth structure is an image forming apparatus having at least an image forming body and plural developing means for forming toner image onto the above-mentioned image forming body, wherein the above-mentioned developing means are provided in the front side of the image forming apparatus and the outer door positioned in front of the apparatus is provided with an attachment and detachment guide for the above-mentioned developing means.

DETAILED DESCRIPTION OF THE INVENTION

Figure 1:
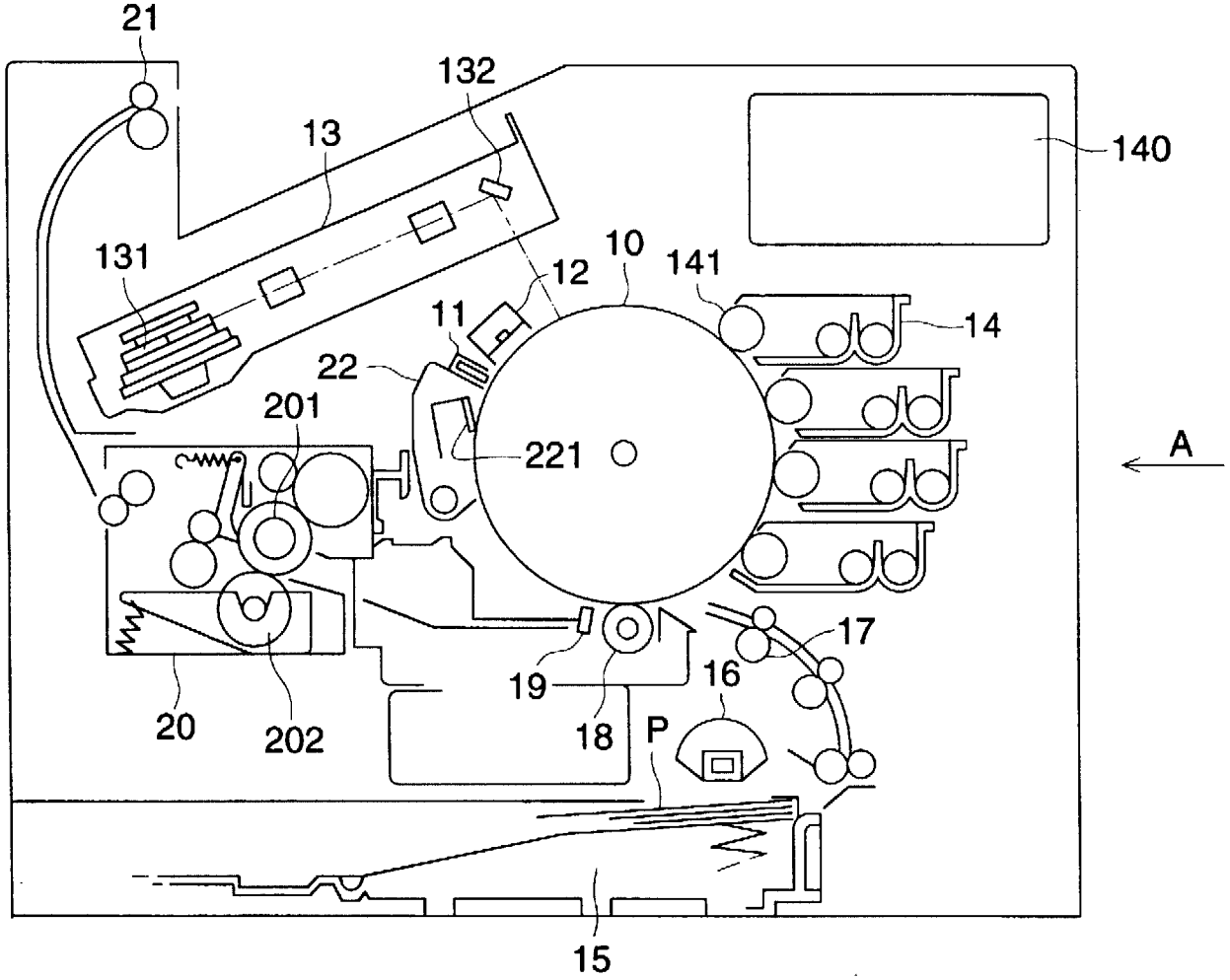
FIG. 1 is a cross sectional schematic diagram of an image forming apparatus.

In FIG. 1, numeral 10 represents a photoreceptor drum, which is an image forming body. It is a grounded drum coated with an OPC photoreceptor. It is driven and rotated in a clockwise direction. Numeral 12 is a scorotron charger. Uniform charge $V_H$ is induced to the circumference of photoreceptor drum 10 by means of a grid and a corona discharge wire whose potential are kept at $V_G$. Prior to charging by means of the scorotron charger, in order to remove trace of the photoreceptor from previous printing, exposure by means of PCL 11 using light-emitting diode was conducted so that circumference of the photoreceptor is discharged.

After uniform charging onto the photoreceptor, image exposure based on an image signal is conducted by means of image exposure means 13. Image exposure means 13 uses a laser diode (not illustrated) as a light-emitting source. Light passes through rotating polygonal mirror 131 and an fθ lens, and its optical path is curved by reflection mirror 132, and thereby scans images. Due to rotation (secondary scanning) of photoreceptor drum 10, a latent image is formed. In the present example, a character portion is exposed to light, resulting in a reversed latent image in which the potential $V_L$ of the character portion is lower.

Around the circumference of photoreceptor 10 are developing devices 14 respectively housing a developer which is composed of a yellow (Y), magenta (M), cyan (C) and black (B) toner and a carrier. First, development for the first color is conducted by development sleeve 141 which houses a magnet and which maintains a developer for rotation. The developer is composed of a carrier wherein an insulating resin is coated on a core ferrite and a toner to which a pigment for each color having polyester as the main material, a charge controller, silica and titanium oxide. The thickness of the developer is restricted to 100–600 μm on development sleeve 141 by means of a layer formation means, and then, conveyed to development region.

In the development region, space between development sleeve 141 and photoreceptor drum 10 is thicker than the layer thickness of the developer, i.e., 0.2–1.0 mm. Between the above-mentioned space, AC bias of $V_{AC}$ and DC bias of $V_{DC}$ are superposed to be imprinted. Toner charge, between $V_{DC}$ and $V_H$, has the same polarity. Accordingly, toner which was given chance of splitting off from the carrier due to $V_{AC}$ is not adhered on $V_H$ having higher potential than $V_{DC}$, but is adhered on $V_L$ portion having lower potential than $V_{DC}$ so that visualizing (reversal development) is conducted.

After finishing visualization for the first color, image forming process for the second color starts. The photoreceptor is uniformly charged by means of scorotron charger 12 again. The latent image by means of image data for the second color is formed by means of image exposure means 13. In this occasion, discharge by means of PCL 11, which was conducted in the image forming process for the first color, is not conducted since toner adhered on the image portion of the first color splashes due to abrupt reduction of the surrounding potential.

On photoreceptor 10 in which the potential becomes $V_H$ over through the entire surface, on portions wherein there is no image of the first color, similar latent images are formed and development is conducted. However, on portions where there is an image of the first color and development is conducted there again, a latent image of $V_M$ is formed due to light shielding caused by toner adhered for the first color and charge which the toner itself has and development in accordance with potential difference of $V_{DC}$ and $V_M$ is conducted. Where images of the first color and the second color superpose, if development for the first color is conducted after producing a latent image of $V_L$, balance of the latent image for the first color and for the second color is collapsed. Accordingly, amount of exposure for the first color may be reducing for preparing an intermediate potential as shown by $$V_H > V_M > V_L$$

With regard to the third color and fourth color, similar image forming process as the second color are conducted so that four color visual images are formed on the circumference of photoreceptor drum 10.

On the other hand, recording sheet P which was conveyed from paper feeding cassette 15 through arc roller 16 temporarily stops, and, when timing for transferring is arranged, it is fed to a transfer region due to rotation of paper feeding roller 17.

In the transfer region, in synchronizing with the timing of transferring, transfer roller 18 is brought into contact with the circumference of photoreceptor drum 10 so that a multi-color image is simultaneously transferred while sandwiching fed recording sheet.

Next, recording sheet is discharged by peak electrode 19 which is provided having a small space with the recording sheet. Aforesaid recording sheet P is separated from the circumference of photoreceptor drum 10, and then, conveyed to fixing device 20. Due to heating by heat roller 201 and pressing by pressure roller 202, toner is fused, and then, aforesaid recording sheet is ejected to outside of the apparatus through paper ejecting roller 21. Incidentally, after passing of recording sheet P, the above-mentioned transfer roller 18 is separated from the circumference of photoreceptor drum 10, and then, prepare for the next forming of toner image.

From photoreceptor drum 10 wherein recording sheet has been separated, residual toner is removed due to contact of blade 221 of cleaning device 22 and is cleaned. Aforesaid photoreceptor drum 10 starts discharge by PCL 11 and enters into image forming process charging by charger 12. Incidentally, the above-mentioned blade 221 moves immediately after cleaning on the surface of the photoreceptor, and retreats from the circumference of photoreceptor drum 10.

Figure 2:
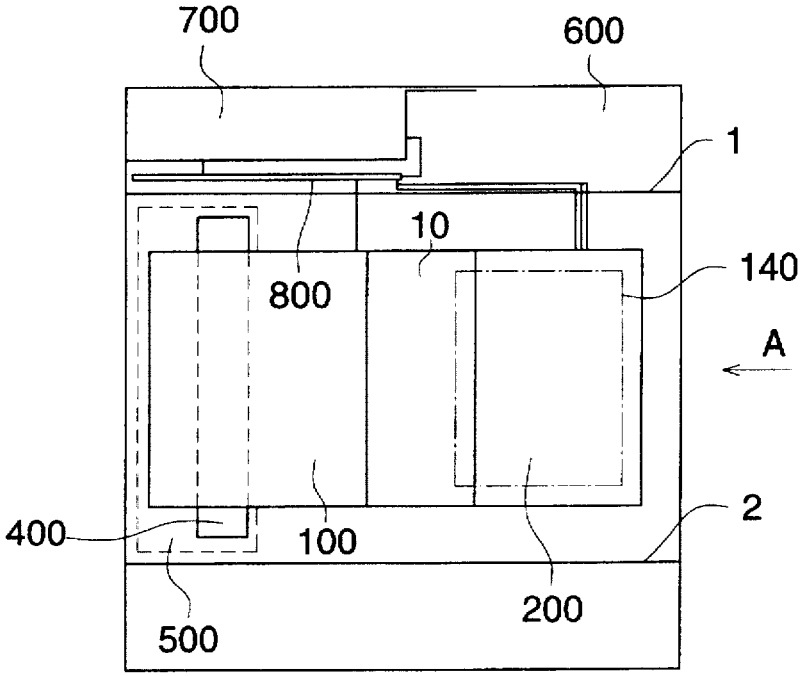
FIG. 2 is a plane layout of the image forming apparatus.

FIG. 2 shows plane layout of each unit constituting the above-mentioned apparatus. A side directed by an arrow A corresponds to the front of the apparatus, i.e., side of the operation side.

The apparatus main body has two side panels 1 and 2 which stand vertically. Between aforesaid side panels, writing unit 100 which is the above-mentioned image exposure means 13, photoreceptor drum 100, development unit 200 which houses plural developing devices 14, unit 400 for fixing device 20 and DC power supply unit 500 is built-in. On the other hand, outside side panel 1, driving system 600, formatter 700 which decodes a printer command and control panels 800 for operation sequence control of the machine. In addition, above the above-mentioned development unit, toner replenishing means 140 connected to each developing device 14 inside the development unit is housed.

The above-mentioned apparatus can be composed of an integral structure as shown in FIG. 1. In addition, it can be composed of separated structure comprising first main body I housing image exposure means 13, paper feeding cassette 15, transfer roller 18 and fixing device 20 and second main body II housing photoreceptor drum 10, chargers 12, developing devices 14 and cleaning device 22. In this occasion, an image forming apparatus is separated to first main body I and second main body II.

Second main body II is located above transfer device 18 and upstream of fixing device 20 relating to the sheet feeding direction, it forms upper surface of the apparatus main body and a part of outer cover on the front side.

The above-mentioned second main body II can be moved from a position where the second main body II is attached to the first main body, toward an upstream direction of a sheet feeding direction so that the second main body is set at a prescribed drawing position. In this occasion, the second main body II including photoreceptor drum 10 retreats from a position capable of image forming and widely opens conveyance surface of recording sheet P.

Figure 3:
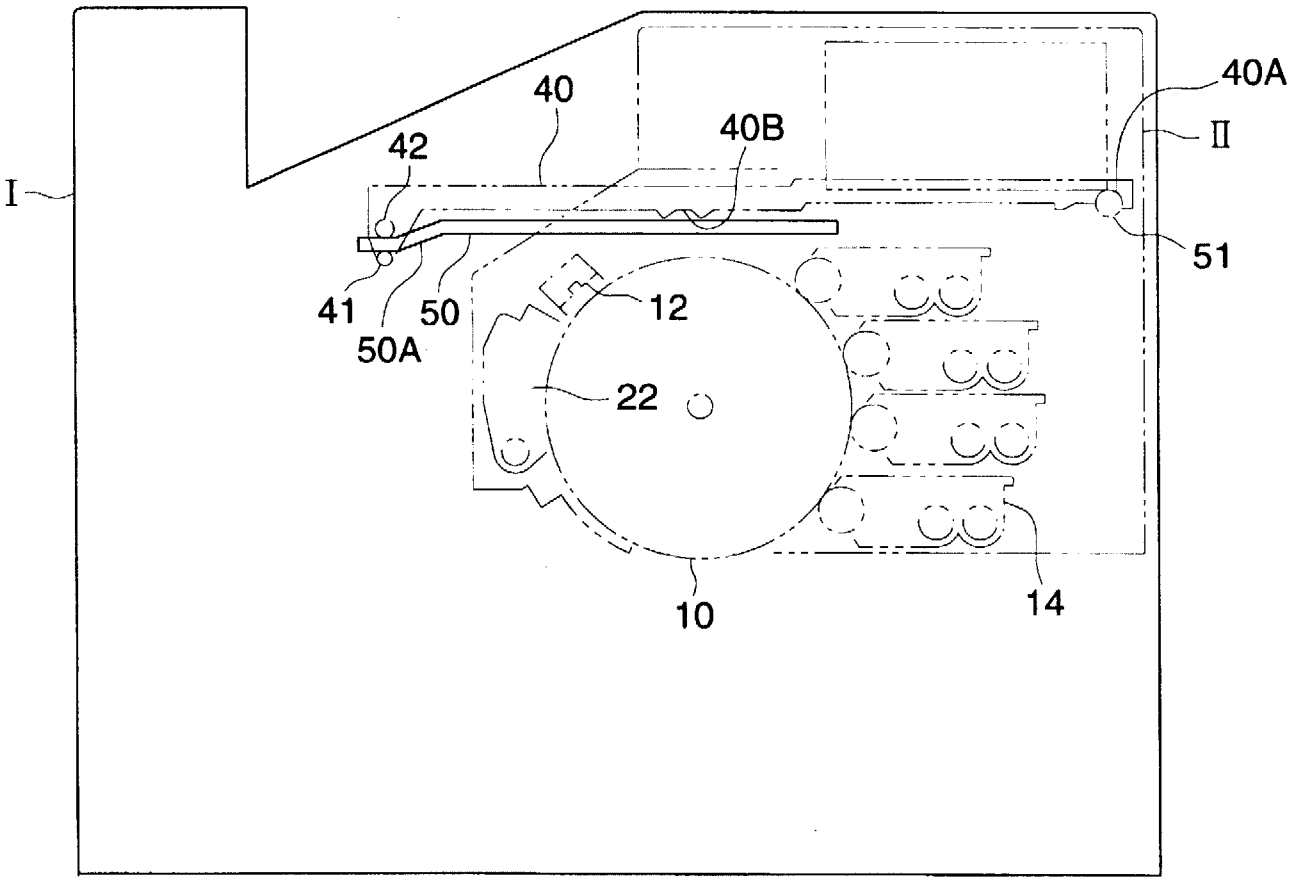
FIG. 3 is an explanation drawing showing moving style of the second main body (No. 1).
Figure 4:
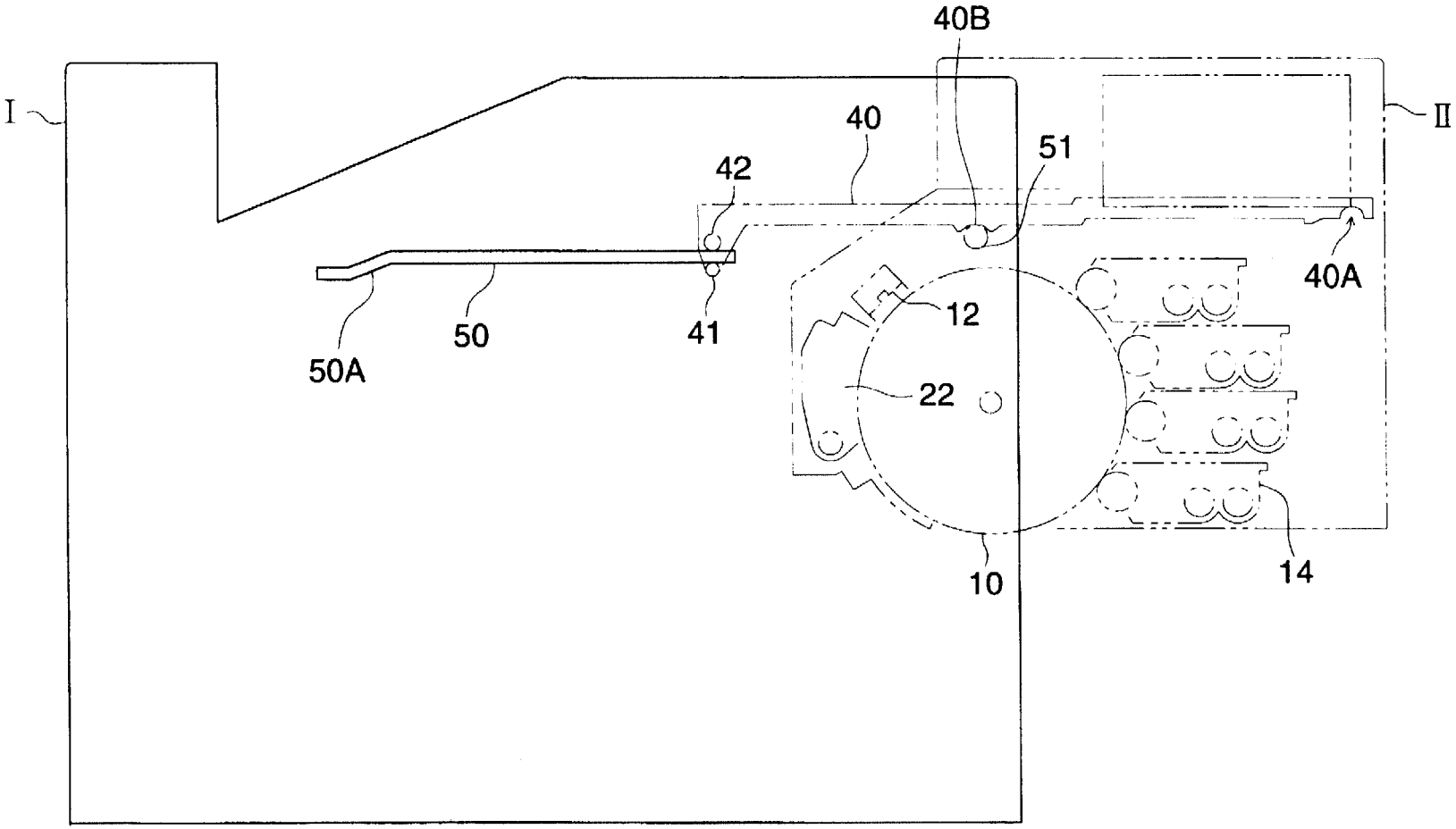
FIG. 4 is an explanation drawing showing moving style of the second main body (No. 2).

FIGS. 3 and 4 respectively show the position of second main body II located at the apparatus position and the drawing position. Due to illustration convenience sake, second main body II side is shown in a double dashed line.

Inside each inner surface of side panels 1 and 2 inside first main body I described above, guide rail 50 having inclined surface 50A and pillar type guide pin 51 is correspondingly provided.

On the other hand, second main body II has, on its left and right side surface, rotatable guide rollers 41 and 42 and plate-shaped member 40 having a demi-circle notch 40A. Due to guide rollers 41 and 42, the above-mentioned guide rail 50 is sandwiched. In addition, while notch 40A is engaged with and supported by the above-mentioned guide pin 51, second main body II is loaded to first main body and photoreceptor drum 10, etc. are set in positions where image formation is possible.

After canceling engagement between the above-mentioned notch 40A and guide pin 51, when second main body II is shifted to the counter direction of arrowed A direction, the above-mentioned guide rollers 41 and 42 move along inclined surface 50A of guide rail 50. Due to this action, photoreceptor drum 10 slightly rises, and moves approximately horizontal direction while avoiding contacting with transfer roller 18 and paper feeding roller 17. Notch 40B provided on plate-shaped member 40 is engaged with the above-mentioned guide pin 51, and is set at its drawing position. Concurrently with this, power, electrical power and control connection supplied from first main body I are also canceled.

DETAILED DESCRIPTION OF THE PREFERRED EMBODIMENT (Example)

An example of the present invention will be explained referring to FIGS. 5 (*a*) and 5 (*b*).

Figure 5:
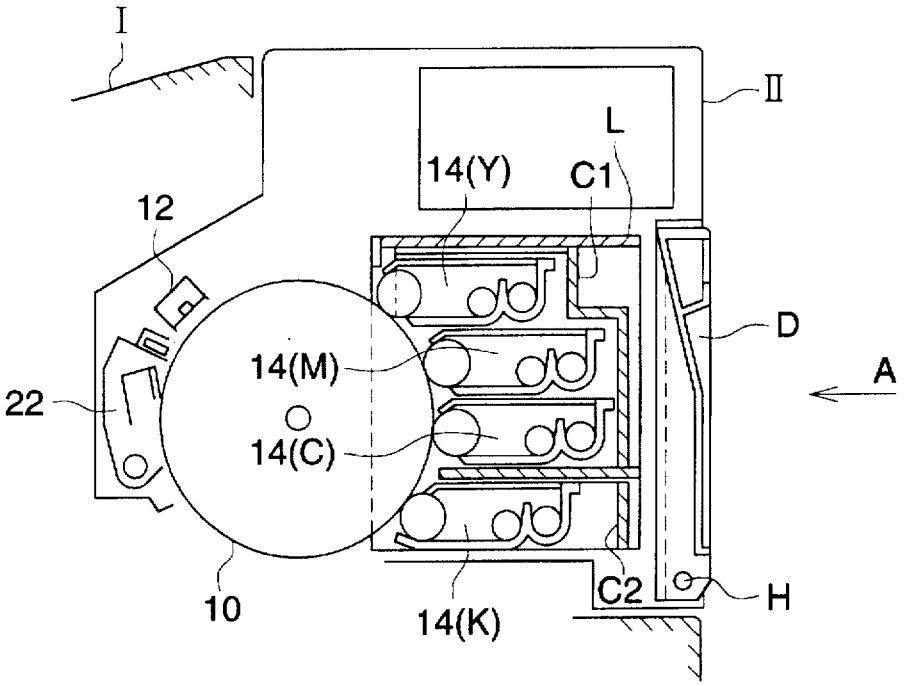
FIGS. 5(*a*) and (*b*) is a schematic drawing showing attachment or detachment of developing devices to or from the second main body.
Figure 5:
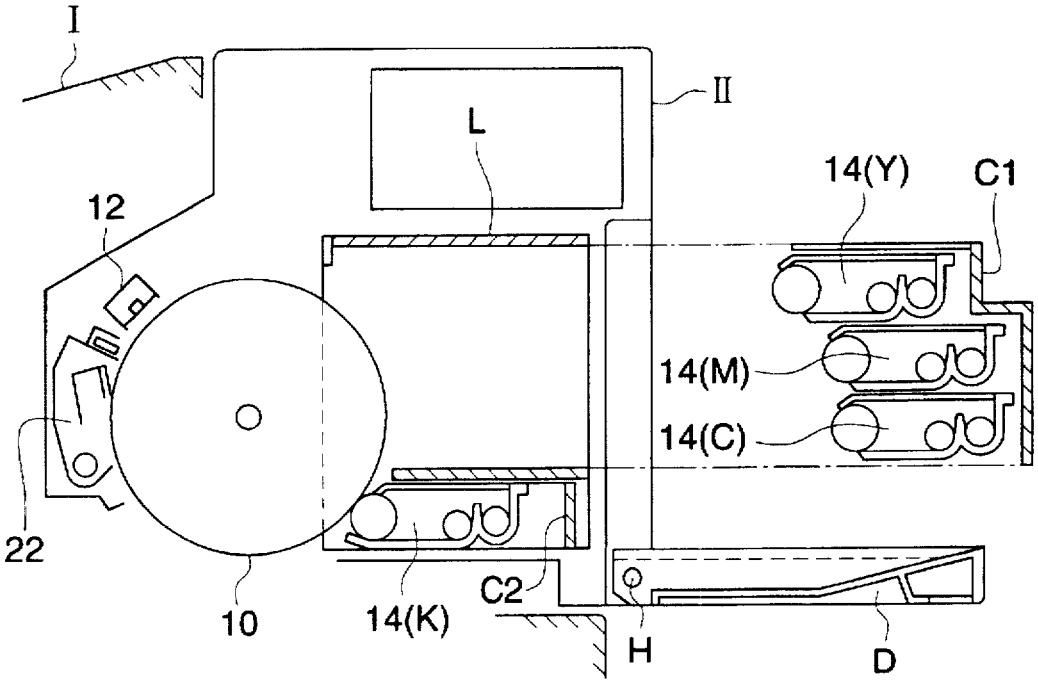

FIG. 5(*a*) shows a major portion of the image forming apparatus when aforesaid apparatus takes a separated structure, wherein each developing device 14(Y), 14(M) and 14(C) housing a yellow, magenta and cyan developer are loaded in development cartridge C1 and developer 14(K) housing a black developer is loaded in development cartridge C2 which is a different cartridge from the above-mentioned development cartridge C1. Each cartridge is loaded in carriage L which is fixed inside the above-mentioned second main body II in an arrowed direction A. Each cartridge faces the circumference of photoreceptor drum 10, and is set at a position capable of forming a prescribed image.

Due to a locking mechanism in which each development cartridge can engaging and can also canceling engaging with a simple operation, each development cartridge is loaded to carriage L attachably or detachably. In addition, in accordance with attachment or detachment, connection and cancellation of connection of power, electrical power and control connection supplied from the main body through second main body to each developing device are conducted automatically.

In addition, second main body II is opened with supporting shaft H as its center to the side of the apparatus (the side surface arrowed by A), and as shown in FIG. 5(*b*), it is provided with a strong external door D so that it can be placed horizontally.

When each development cartridge is attached or detached, the above-mentioned outer door D is opened. Each developing device can easily be attached or detached from the side of the apparatus, not drawing second main body II, i.e. while second main body II is placed in the image forming position. Due to this mechanism, the developing means can easily be attached or detached surely, without losing weight balance of the apparatus. In addition, even if the development cartridge drops, the above-mentioned outer door D serves a function of receiving stand. Accordingly, there is no possibility of damaging. In addition, partiality of the developers therein, causing adverse effect on image formation thereafter, can be prevented.

Embodiment of the above-mentioned outer door will be explained referring to FIGS. 6(*a*) to 8(*b*).

Figure 6:
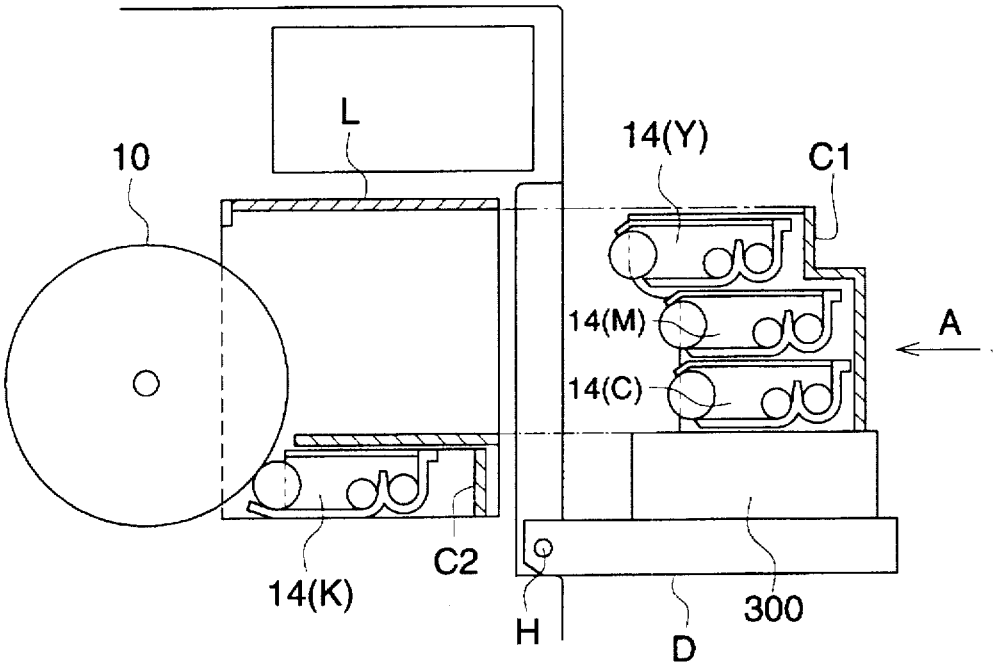
FIGS. 6(*a*) and 6(*b*) is a schematic drawing showing attachment or detachment of the developing device by means of a guide member.
Figure 6:
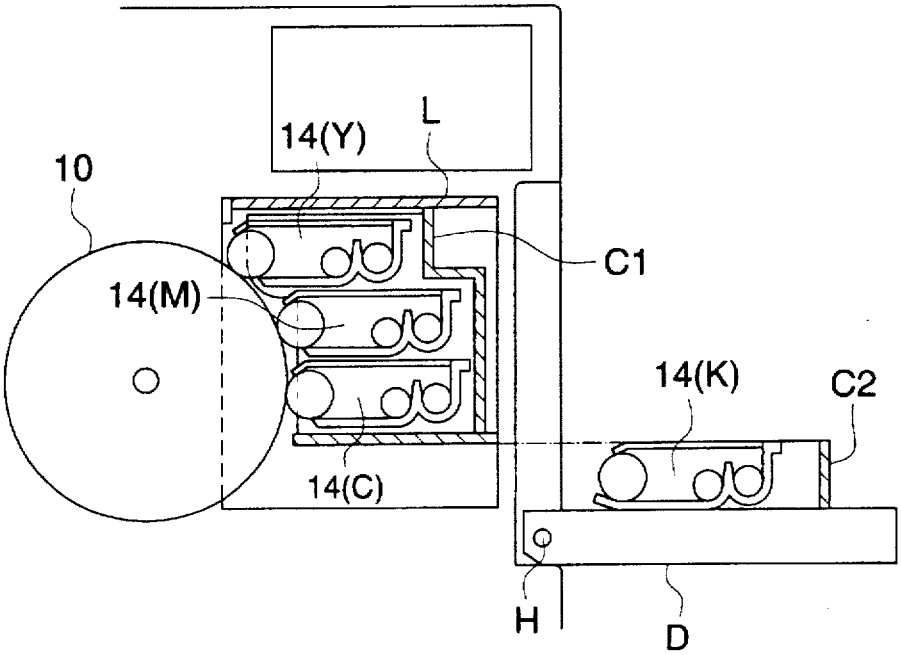

In addition, second main body II is opened with supporting shaft H as its center to the side of the apparatus (the side surface arrowed by A), and as shown in FIG. 6(*b*), it is provided with a strong outer door D so that it can be placed horizontally.

Figure 7:
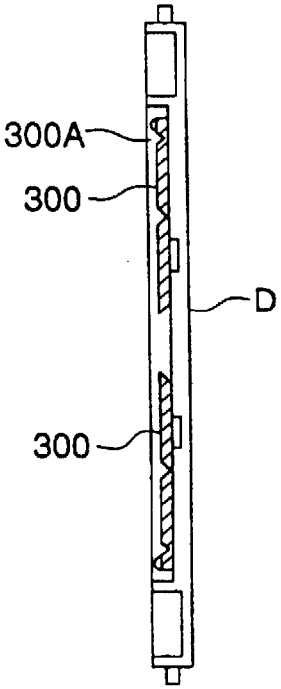
FIGS. 7(*a*) and 7(*b*) shows a plane drawing and a cross sectional view of an outer door housing a guide member.
Figure 7:
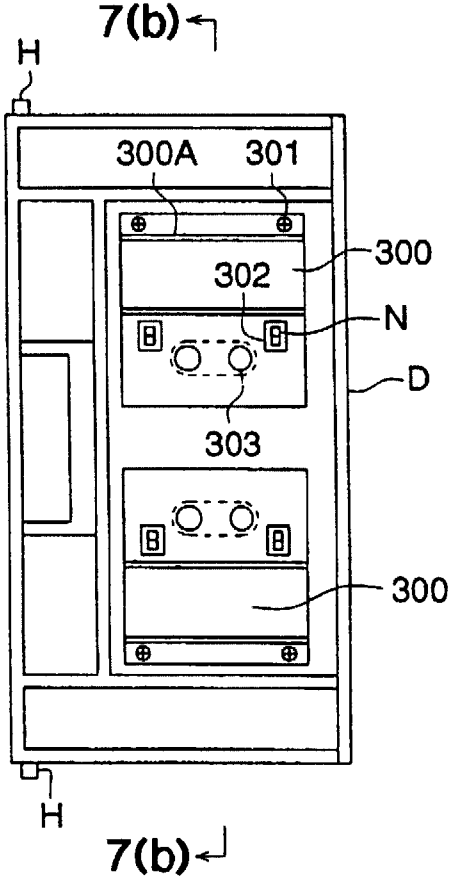

With regard to the above-mentioned outer door D, inside surface thereof, i.e., on the top surface when it is opened, as shown in FIGS. 7(*a*) and 7(*b*), paired guide plates 300 are provided, as attachment and detachment guide member for the development means, in such a manner as to be in a synchronous position perpendicular to the attachment or detachment direction of the development cartridge.

Each of the above-mentioned guide plates 300 is formed by a flat and hard synthetic resin plate. On each guide plate, two wedge groove 300A is cut so that mountain type deformation due to folding is possible. In addition, guide plate 300 i s also provided with corner holes 302 for penetrating through engaging claws N protruded from the outer door D and round holes 303 for coupling fingers. One of end portions is fixed to outer door D by means of small screw 301

Figure 8:
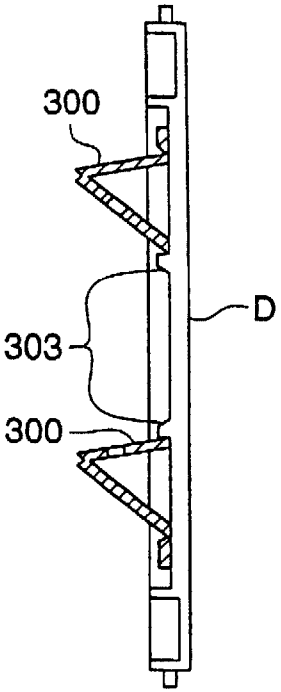
FIGS. 8(*a*) and 8(*b*) shows a plane drawing and a cross sectional view of an outer door housing a guide member.
Figure 8:
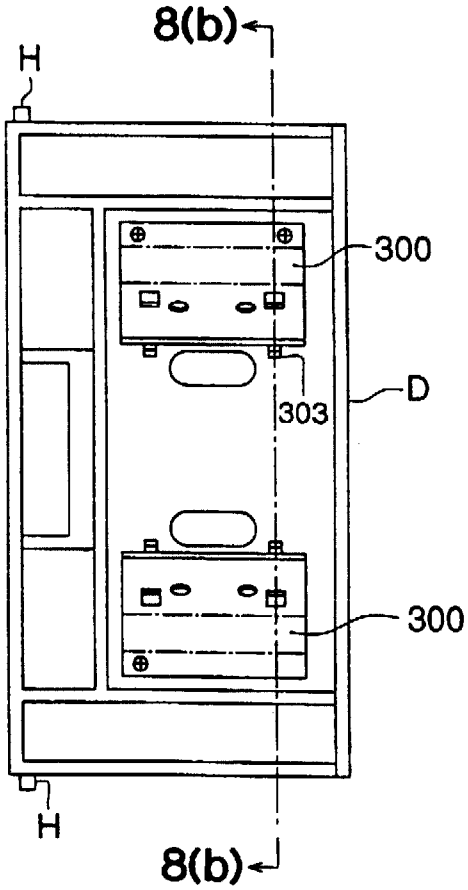

For attaching or detaching the development cartridge, outer door D is opened as shown in FIGS. 6(*a*) and 6(*b*) so that it is placed horizontally. Following this, in the case of attaching or detaching development cartridge Cl, the above-mentioned guide plates 300 vertically stand by utilizing round holes 303. The other end is engaged with engaging claw N on outer door D so that guide plates 300 are folded to a mountain shape having a prescribed height as shown in FIGS. 8(*a*) and 8(*b*).

As shown in FIG. 6(*a*), the tops of folded guide plates 300 meet the bottom surface of development cartridge C1 detached horizontally against carriage L. Due to this structure, development cartridge C1 is supported and guided by guide plates 300 and thereby can extremely easily be detached In addition, danger of damage due to dropping can be avoided.

In addition, when development cartridge C2 is detached, as shown in FIG. 7(*b*), the above-mentioned guide plate 300 wherein cross sectional B—B is shown in 7(*a*) remain flat, so that the height of top surface of outer door D meets the bottom surface of development cartridge C2. Development cartridge C2 is supported and guided by outer door D. In the same manner as in development cartridge C1, C2 is extremely easily detached and dropping can be avoided.

Incidentally, outer door D equipped with guide plate 300 is also applicable to an image forming apparatus having separation structure. In this case, the above-mentioned outer door D is provided in front of second main body of the apparatus so that each development cartridge is supported and, guided to be detachable without drawing second main body II from the apparatus main body.

Owing to the present invention, plural developing means housed in an apparatus can be attached or detached easily and safely in which no trouble such as dropping of the developing means is followed from the side of the apparatus with easy operation, without largely opening the apparatus main body or drawing the developing means from the apparatus main body. Accordingly, maintenance becomes easy and always complete so that an image forming apparatus capable of obtaining an image with high quality can be provided.

What is claimed is:

1. An image forming apparatus comprising:

(a) an image forming body;

(b) transfer means for transferring the toner image onto a recording sheet;

(c) fixing means for fixing the toner image on recording sheet;

(d) processing means for image formation, including charging means for charging the image forming body, developing means for forming a toner image on the image forming body, or cleaning means for cleaning the image forming body;

(e) a first body including the transfer means;

(f) a second body provided over the transfer means, including the image forming body, and at least one of the processing means, wherein the second body is movable with respect to the first body, and movable between a first position in which an image formation can be carried out and a second position in which the second body is drawn out, and wherein the processing means can be drawn out from the second body when the second body is located at the first position, and (g) an upper outer cover, wherein a part of the cover is formed by the second body.

2. The apparatus of claim 1, wherein the processing means is the developing means.

3. The apparatus of claim 1, wherein the second body is moved substantially in a horizontal direction.

4. The apparatus of claim 3, wherein the second body is moved in a direction parallel to a conveyance direction of the recording sheet.

5. The apparatus of claim 1, wherein the second body is located in an upstream side of the fixing means.

6. The apparatus of claim 1, wherein the second body further comprises a door through which the processing means is attached to or detached from the second body.

7. The apparatus of claim 6, wherein the processing means is drawn out in a direction parallel to a conveyance direction of the recording sheet and in a horizontal direction.

8. An image forming apparatus comprising:

(a) an image forming body;

(b) transfer means for transferring the toner image onto a recording sheet;

(c) fixing means for fixing the toner image on recording sheet;

(d) processing means for image formation, including charging means for charging the image forming body, developing means for forming a toner image on the image forming body, or cleaning means for cleaning the image forming body;

(e) a first body including the transfer means; and (f) a second body provided over the transfer means, including the image forming body, and at least one of the processing means, wherein the second body is movable with respect to the first body, and movable between a first position in which an image formation can be carried out and a second position in which the second body is drawn out, wherein the processing means can be drawn out from the second body when the second body is located at the first position, wherein the second body further comprises a door through which the processing means is attached to or detached from the second body, wherein the processing means is drawn out in a direction parallel to a conveyance direction of the recording sheet and in a horizontal direction, and wherein the door further has a function for guiding the processing means to be attached to or detached from the second body.

* * * * *